US009444204B2

(12) United States Patent
Yen et al.

(10) Patent No.: US 9,444,204 B2
(45) Date of Patent: Sep. 13, 2016

(54) SERIAL BUS CONNECTOR

(71) Applicant: Chant Sincere Co., Ltd., New Taipei (TW)

(72) Inventors: Ming Hui Yen, New Taipei (TW); Chun-Hsiang Hsu, New Taipei (TW)

(73) Assignee: CHANT SINCERE CO., LTD. (TW)

( * ) Notice: Subject to any disclaimer, the term of this patent is extended or adjusted under 35 U.S.C. 154(b) by 0 days.

(21) Appl. No.: 14/672,771

(22) Filed: Mar. 30, 2015

(65) Prior Publication Data

US 2016/0064879 A1 Mar. 3, 2016

(30) Foreign Application Priority Data

Aug. 29, 2014 (TW) ..... 103215436 U

(51) Int. Cl.
*H01R 13/648* (2006.01)
*H01R 24/78* (2011.01)

(52) U.S. Cl.
CPC ..... *H01R 24/78* (2013.01)

(58) Field of Classification Search
CPC ..... H01R 13/6581
USPC ..... 439/607.01
See application file for complete search history.

(56) References Cited

U.S. PATENT DOCUMENTS 8,784,134 B2 * 7/2014 Wu ..... H01R 13/6598 439/607.05
2015/0194772 A1 * 7/2015 Little ..... H01R 13/6597 439/357
2015/0244110 A1 * 8/2015 Ju ..... H01R 13/6585 439/607.01
2015/0270659 A1 * 9/2015 Kao ..... H01R 24/64 439/607.01
2015/0340821 A1 * 11/2015 Yen ..... H01R 24/62 439/607.01
2016/0049756 A1 * 2/2016 Yen ..... H01R 24/60 439/676

* cited by examiner

*Primary Examiner* — Vanessa Girardi
(74) *Attorney, Agent, or Firm* — Bacon & Thomas, PLLC

(57) ABSTRACT

A serial bus connector is provided comprising as least one insulated body having a plurality of openings, a plurality of rows of terminals, a base assembly, at least one conductive cover, and an outer shielding. The at least one conductive cover is located upon an outer surface of a side wall of the insulated body, and comprises a plurality of first conductive portions and second conductive portions. The first conductive portions are formed by bending the conductive cover toward a direction of the inside of the insulated body, and the second conductive portions are formed by bending the conductive cover toward an opposite direction of the insulated body. The first conductive portions pass through the openings of the insulated body to extend into the inside of the insulated body for electrically connecting with another complementary connector.

18 Claims, 5 Drawing Sheets

SERIAL BUS CONNECTOR

CROSS-REFERENCE TO RELATED APPLICATIONS

This application claims the benefit of the filing date under 35 U.S.C. §119(a)-(d) of Taiwan Patent Application No. 103215436, filed Aug. 29, 2014.

BACKGROUND OF THE INVENTION

1. Field of the Invention

The present invention relates to a serial bus connector, and more particularly to a serial bus connector which is in conformity with the specifications of USB 3.1 and has a robust and small structure.

2. Description of the Related Art

With the rapid development of technology, a variety of electronic devices (such as mobile phones, tablets, and digital cameras) have become widely utilized. In general, those electronic devices can be connected with a computer for transmitting data via a variety connectors, and universal serial bus (USB) connectors in particular have been widely applied.

With the development of the technique of the USB connectors, the transmission speed has increased from 1.5 Mbit/s (USB 1.0) to 5 Gbit/s (USB 3.0). However, the type of USB connector used in most electronic devices is Micro USB, for which the transmission speed is 480 Mbit/s (USB 2.0). Therefore, to meet the new generation electronic devices, a new USB 3.1 Type-C which is based on the specifications of USB 3.0 has been developed. The size of USB 3.1 Type-C is close to the size of Micro USB, and the transmission speed of USB 3.1 Type-C has been increased to 10 Gbit/s.

Another advantage of USB 3.1 Type-C is that it allows for plugging into another complementary connector via up or down orientation. That is, the connector of USB 3.1 Type-C comprises a certain number of terminals which are arranged in a particular manner for achieving the above requirements. However, by accommodating a large number of terminals in a limited space, the whole structure of the USB connector may become weak, thereby failing to achieve the requirement of plugging and unplugging more than ten thousand times.

Therefore, it is necessary to provide a new serial bus connector which has a firm structure design, and the size, the number of terminals, and the manner in which the terminals are arranged are in conformity with the specifications of USB 3.1 Type-C.

SUMMARY OF THE INVENTION

In order to solve the above-mentioned technical problems, an objective of the present invention is to provide a serial bus connector which is in conformity with the specifications of USB 3.1 and has a robust and small structure thereby providing the connector with a longer service life.

In order to achieve the above objects, the present invention provides a serial bus connector which comprises an insulated body, comprising at least one side wall including a plurality of openings formed thereon and a first end for connecting with a complementary connector; a plurality of rows of terminals; a base assembly for accommodating a part of each terminal and being assembled with the insulated body; at least one conductive cover located upon an outer surface of the side wall of the insulated body, each conductive cover comprising a plurality of first conductive portions which are formed by bending the conductive cover toward a direction of an inside of the insulated body, where the first conductive portions respectively pass through the openings of the insulated body to extend into the inside of the insulated body for electrically connecting with the complementary connector; a plurality of second conductive portions which are formed by bending the conductive cover toward an opposite direction of the insulated body; and an outer shielding sleeved onto the insulated body and the at least one conductive cover, where the plurality of second conductive portions are electrically connected with the outer shielding.

In one preferred embodiment of the present invention, the plurality of first conductive portions and the plurality of second conductive portions are arranged spaced apart along a straight line.

In one preferred embodiment of the present invention, each terminal comprises a spring contact section, a retaining section, and a connecting section, and the insulated body comprises a plurality of terminal passages formed on two opposite side walls of the insulated body for accommodating the spring contact section of the terminal.

In one preferred embodiment of the present invention, the insulated body comprises two opposite side walls, and the plurality of openings are respectively formed on the two opposite side walls of the insulated body and adjacent to the first end.

In one preferred embodiment of the present invention, the base assembly comprises a first terminal seat and a second terminal seat being disposed superposed one upon the other. Each terminal seat is used for accommodating the part of each terminal. A pair of engaging units are respectively formed on two opposite side walls of each terminal seat and two opposite side walls of the insulated body for engaging with each other. Each engaging unit comprises at least one pair of structurally complementary protrusive section and notch section, thereby engaging the insulated body with the base assembly.

In one preferred embodiment of the present invention, the base assembly comprises a central plate disposed between the first terminal seat and the second terminal seat, and the central plate comprises: at least one elastic arm extended toward an end of the plurality of rows of terminals, where a hook section is formed on an end of the at least one elastic arm for electrically connecting with the complementary connector; and a ground extended toward another end of the plurality of rows of terminals.

In one preferred embodiment of the present invention, the first terminal seat comprises at least one blind hole, the second terminal seat comprises at least one post, and the central plate comprises at least one through hole; the post is passed through the through hole and disposed in the blind hole.

In one preferred embodiment of the present invention, the two opposite side walls of the insulated body comprise at least one embedding slot for accommodating the elastic arm of the central plate.

In one preferred embodiment of the present invention, the at least one insulated body comprises at least one concave portion corresponding to the at least one conductive cover. The concave portion has a same contour as the conductive cover, and a dent depth of the concave portion is greater than or equal to a thickness of the conductive cover.

The present invention further provides a serial bus connector which comprises an insulated body, comprising at least one side wall including a plurality of openings formed thereon and a first end for connecting with a complementary connector; a plurality of rows of terminals; a base assembly comprising a plurality of terminal seats being disposed superposed one upon the other, each terminal seat is used for accommodating a part of each terminal and engaging with the insulated body; at least one conductive cover located upon an outer surface of the side wall of the insulated body; and an outer shielding sleeved onto the insulated body and the at least one conductive cover, where the conductive cover is electrically connected with the outer shielding.

In one preferred embodiment of the present invention, the plurality of base seats comprise a first terminal seat and a second terminal seat. A pair of engaging units are respectively formed on two opposite side walls of each terminal seat and two opposite side walls of the insulated body for engaging with each other. Each engaging unit comprises at least one pair of structurally complementary protrusive section and notch section, thereby engaging the insulated body with the base assembly.

In one preferred embodiment of the present invention, each conductive cover comprises a plurality of first conductive portions which are formed by bending the conductive cover toward a direction of an inside of the insulated body, where the first conductive portions respectively pass through the openings of the insulated body to extend into the inside of the insulated body for electrically connecting with the complementary connector; and a plurality of second conductive portions, which are formed by bending the conductive cover toward an opposite direction of the insulated body, where the plurality of second conductive portions are electrically connected with the outer shielding.

DETAILED DESCRIPTION OF THE EMBODIMENT(S)

Figure 1:
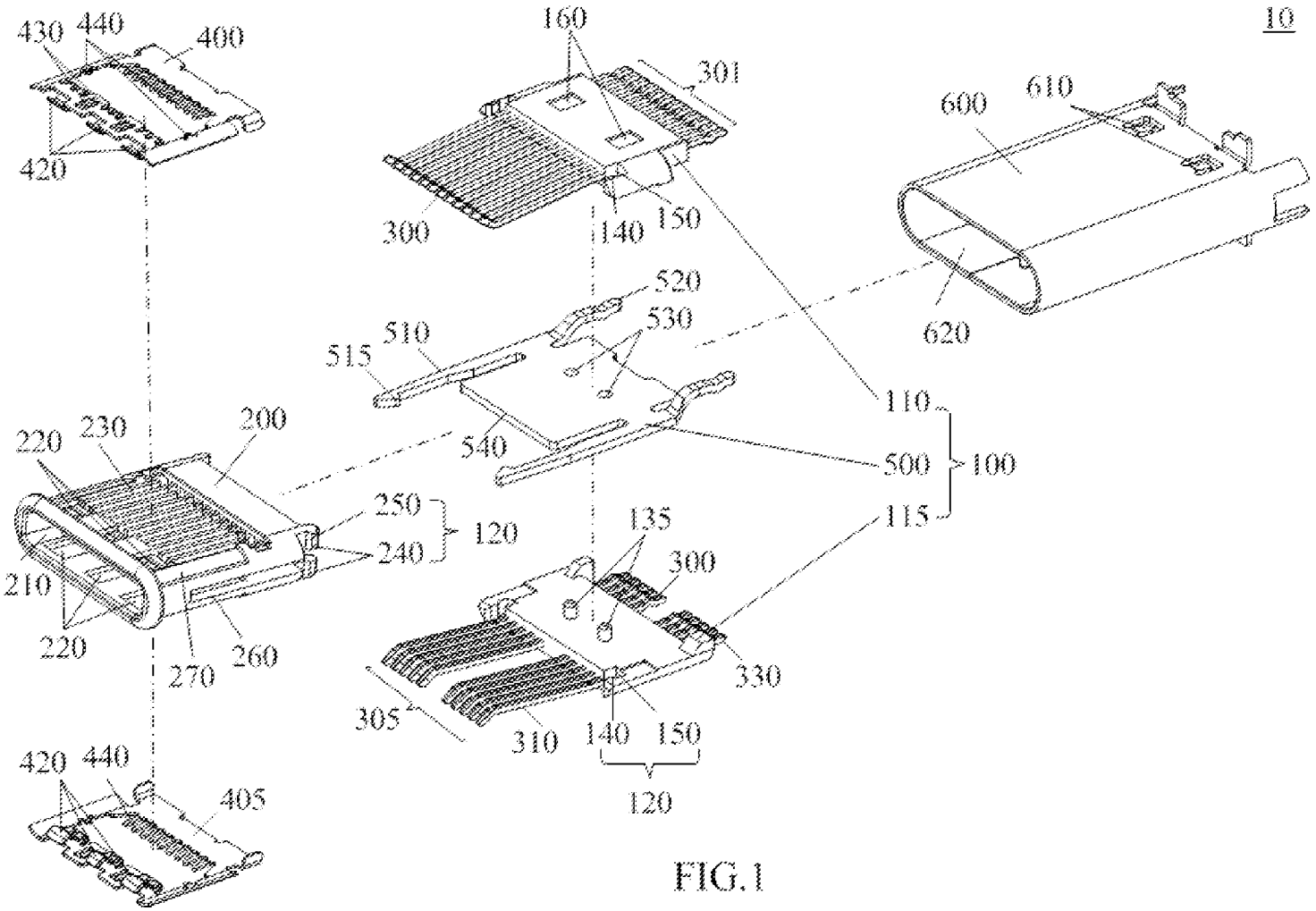
FIG. 1 shows a first view of an exploded diagram of a serial bus connector according to the present invention.

The structure and the technical means adopted by the present invention to achieve the above and other objects can be best understood by referring to the following detailed description of the preferred embodiments and the accompanying drawings. Furthermore, the same reference numerals refer to the same parts or like parts throughout the various figures.

Please refer to FIG. 1, which shows a serial bus connector 10 according to a preferred embodiment of the present invention. The structure of the serial bus connector 10 is in conformity with the specifications of USB 3.1 Type-C. The serial bus connector 10 comprises a base assembly 100, an insulated body 200, a plurality of terminals 300 (including a first row of terminals 301 and second row of terminals 305), a first conductive cover 400, a second conductive cover 405, and an outer shielding 600.

Figure 2:
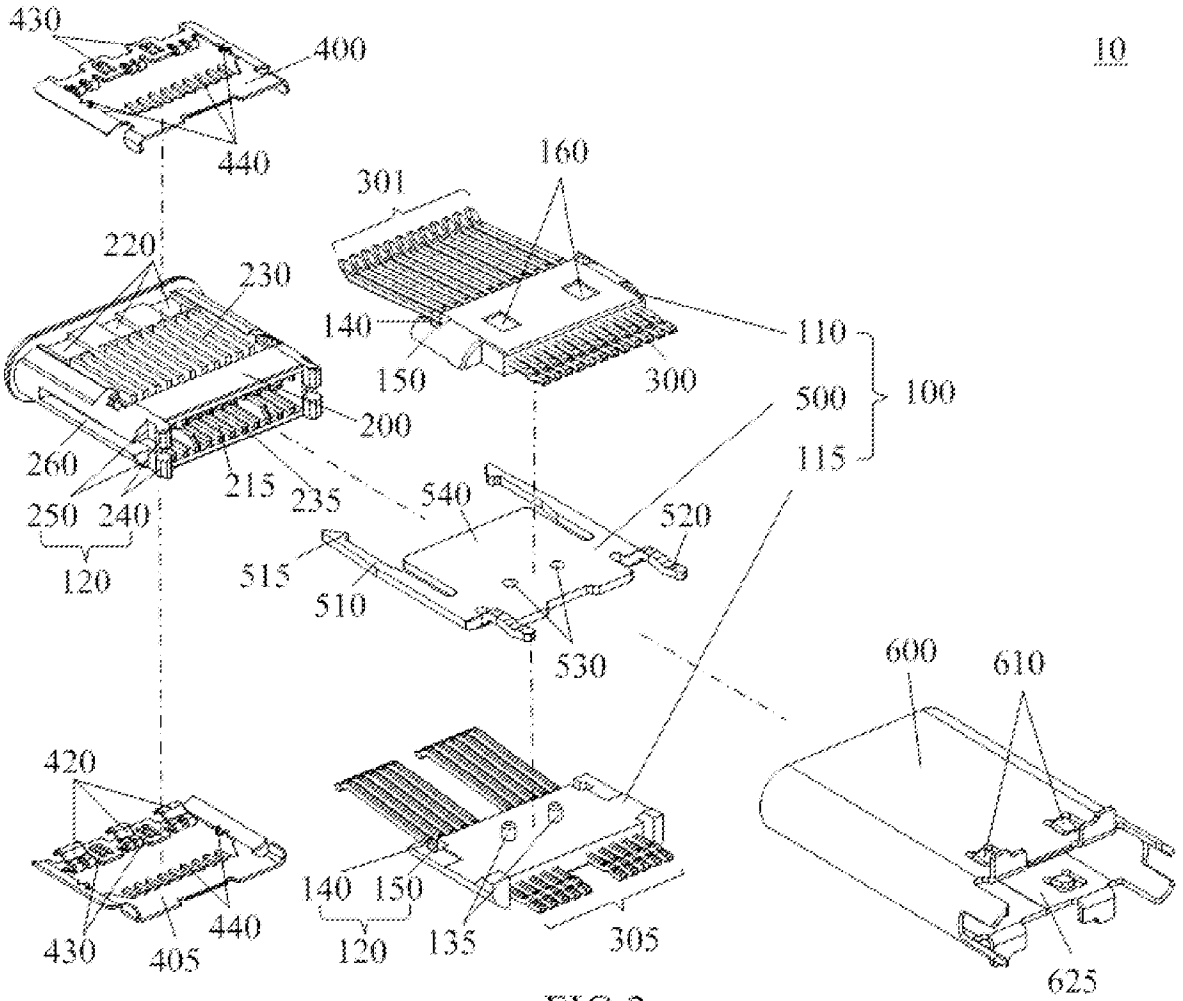
FIG. 2 shows a second view of an exploded diagram of a serial bus connector according to the present invention.
Figure 8:
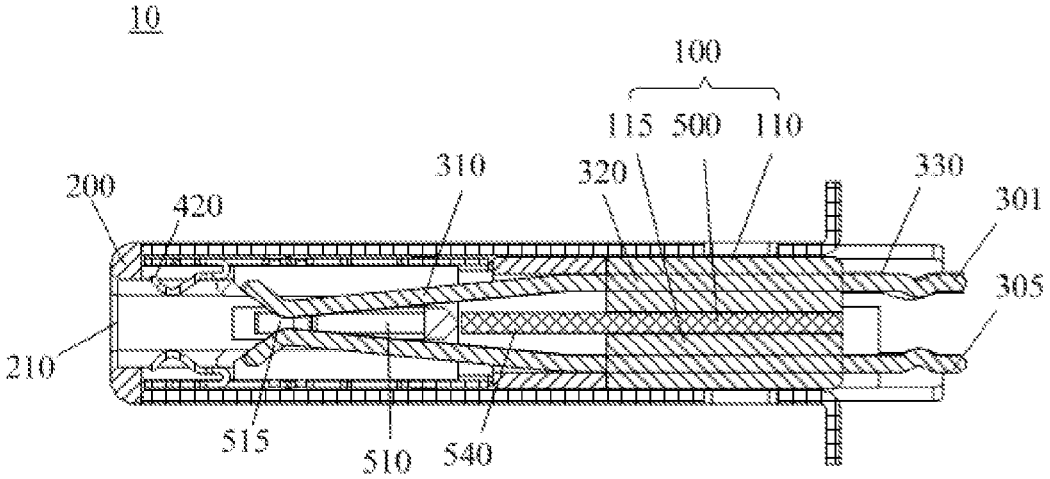
FIG. 8 shows a cross-sectional view along a B-B' cutting line according to FIG. 5 and FIG. 6.

As shown on FIG. 1 and FIG. 2, each terminal 300 of the first row of terminals 301 and the second row of terminals 305 comprises a spring contact section 310, a retaining section 320 (please refer to FIG. 8), and a connecting section 330, where the retaining section 320 is located between the spring contact section 310 and the connecting section 330.

As shown on FIG. 1 and FIG. 2, the base assembly 100 comprises a first terminal seat 110 and a second terminal seat 115, where the first terminal seat 110 and the second terminal seat 115 are disposed superposed one upon the other. The first terminal seat 110 and the second terminal seat 115 respectively accommodate a part of each terminal 300. In this embodiment, the retaining section 320 of each terminal 300 of the first row of terminals 301 is embedded in the first terminal seat 110 by an injection molding process, and the retaining section 320 of each terminal 300 of the second row of terminals 305 is also embedded in the first terminal seat 115, so that the first terminal seat 110 and the second terminal seat 115 of the base assembly 100 are combined with the retaining sections 320 of the terminals 300.

Figure 3:
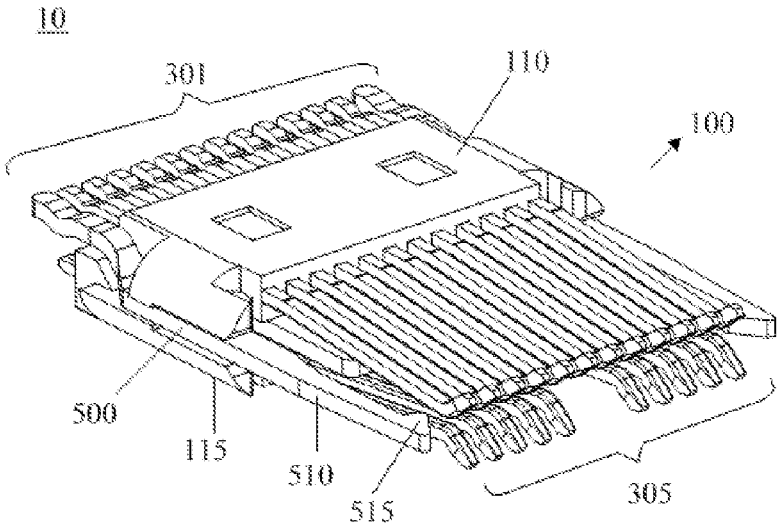
FIG. 3 shows a first partial assembly diagram of a serial bus connector according to the present invention.

As shown on FIG. 1 and FIG. 3, the base assembly 100 further comprises a central plate 500, which is made of conductive metal material. The central plate 500 is disposed between the first terminal seat 110 and the second terminal seat 115 for preventing interference caused by external signals, such as electro-static discharge (ESD) or electromagnetic interference (EMI). The central plate 500 comprises a plate body 540, a pair of elastic arms 510 which are opposite each other, and a pair of grounds 520 which are opposite each other. The plate body 540, the pair of elastic arms 510, and the pair of grounds 520 are a one-piece molded structure. The pair of elastic arms 510 and the pair of grounds 520 are located on two opposite sides of the plate body 540, and a pair of hook sections 515 are respectively formed on the end of the pair of elastic arms 510, and the pair of hook sections 515 extend toward two opposite direction.

Figure 7:
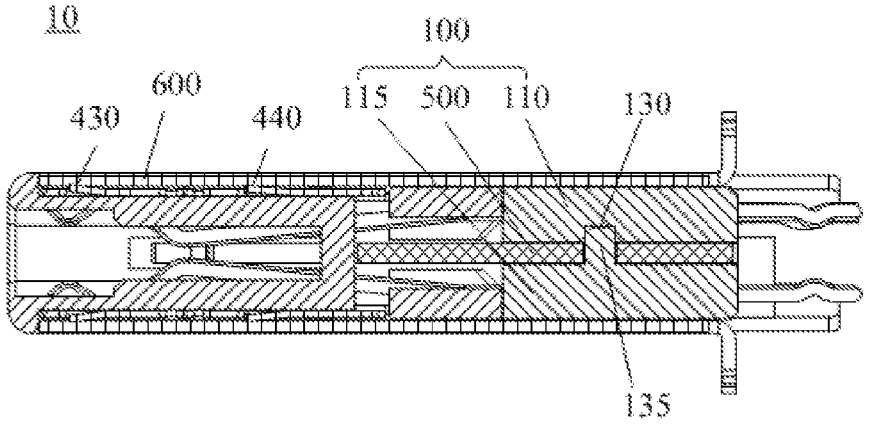
FIG. 7 shows a cross-sectional view along an A-A' cutting line according to FIG. 5 and FIG. 6.

As shown on FIG. 1 and FIG. 3, the plate body 540 comprises a pair of through holes 530, the first terminal seat 110 comprises a pair of blind holes 130 (please refer to FIG. 7), and the second terminal seat 115 comprises a pair of posts 135. When assembled, the pair of elastic arms 510 of the central plate 500 are disposed toward the direction of the spring contact section 310, and the pair of grounds 520 are disposed toward the direction of the connecting section 330 of the terminals 300. The pair of posts 135 of the second terminal seat 115 are passed through the pair of through holes 530 of the central plate 500 and disposed on the pair of blind holes 130 of the first terminal seat 110, so that the first terminal seat 110, the second terminal seat 115, and the central plate 500 are firmly combined together. It should be noted that after assembly, the length of the plate body 540 of the central plate 500 is shorter than the length of the terminals 300, and no portion of the central plate 500 will not contact with any portion of the terminals 300.

As shown on FIG. 1 and FIG. 2, a hollow accommodating space is formed in the insulated body 200, where a first end 210 and a second end 215 represent two through ends. The first end 210 is used for connecting with a complementary connector (not shown), and the second end 215 is used for assembling with the base assembly 100. On the insulated body 200, a first row of passages 230 and a second row of passages 235 are respectively formed on the top and bottom sides, which are adjacent to the first end 210 and the second end 215 for accommodating the spring contact section 310 of the first row of terminals 301 and the second row of terminals 305. The first row of passages 230 and the second row of passages 235 are extended from the second end 215 to the direction of the first end 210 and terminated at a distance from the first end 210. On the top and bottom sides of the insulated body 200, the first row of passages 230 and the second row of passages 235 are formed thereon and a plurality of openings 220 are formed thereon. The plurality of openings 220 are located between a termination region of the first row of passages 230 and the second row of passages 235 and the first end 210.

Figure 4:
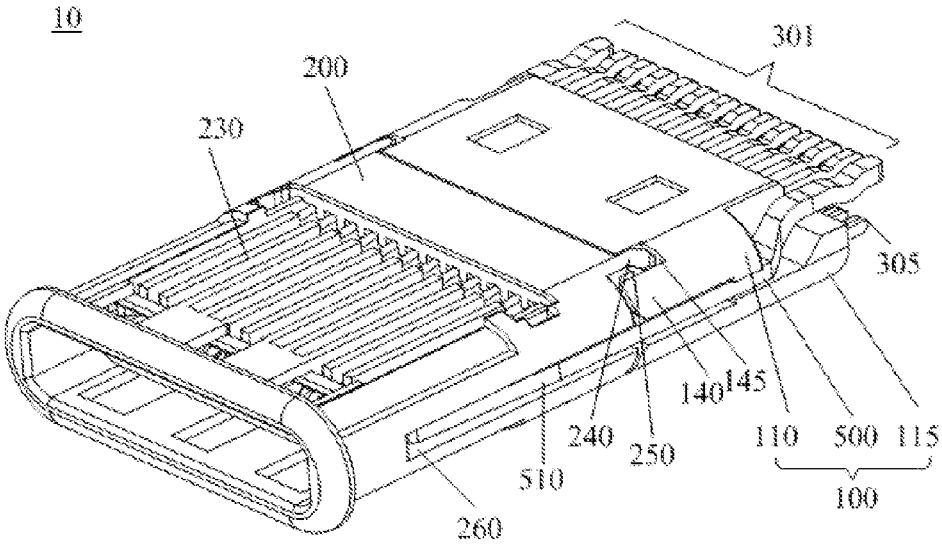
FIG. 4 shows a second partial assembly diagram of a serial bus connector according to the present invention.

As shown on FIG. 1 and FIG. 4, the first terminal seat 110 and the second terminal seat 115 are combined with the central plate 500 to form the base assembly 100, and then which is further combined with the insulated body 200. A pair of engaging units 120 which can engage with one another are respectively formed on the right and left side walls of each terminal seat 110 and 115 and the right and left side walls of the second end 215 of the insulated body 200. Each engaging unit 120 comprises at least one pair of structurally complementary protrusive section and notch section, thereby engaging the insulated body 200 with the base assembly 100. To be more specific, the engaging units 120 are respectively formed on the right and left side walls of the first terminal seat 110 and the second terminal seat 115, and a first protrusive section 140 and a first notch section 150 are formed on each engaging unit 120. Also, the upper and lower engaging units 120 are respectively formed on each side wall of the right and left side walls of the second end 215 of the insulated body 200, and a second protrusive section 240 and a second notch section 250 are formed on each upper and lower engaging units 120. The structures of both the first protrusive section 140 and the second notch section 250 and both the first notch section 150 and the second protrusive section 240 are complementary, so that the first protrusive section 140 and the second protrusive section 240 can be engaged with the corresponding first notch section 150 or the second notch section 250. The engaging result mentioned above is as shown on FIG. 4.

As shown on FIG. 1 and FIG. 4, a pair of embedding slots 260 further are formed on the right and left side walls of the insulated body 200 for accommodating the pair of elastic arms 510 of the central plate 500. The pair of embedding slots 260 extend toward a direction of the first end 210, and the end of each embedding slot 260 comprises a through hole (not shown), which passes through to the inside of the insulated body 200, so that the pair of elastic arms 510 can electrically connect with the complementary connector (not shown).

Figure 5:
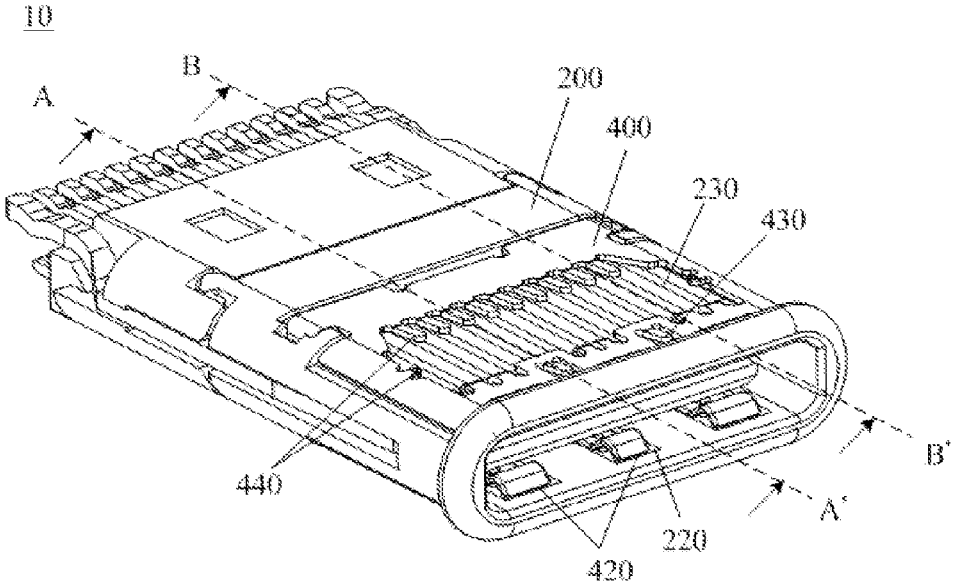
FIG. 5 shows a third partial assembly diagram of a serial bus connector according to the present invention.

As shown on FIG. 1 and FIG. 5, a pair of symmetrical first conductive cover 400 and second conductive cover 405 are respectively disposed on the surface of the first row of passages 230 and the second row of passages 235, which are located on the outer surface of top and bottom side walls of the insulated body 200. The first conductive cover 400 and the second conductive cover 405 respectively have a hollowed-out portion. A plurality of first conductive portions 420 and second conductive portions 430 are formed on one side of the hollowed-out portion. The plurality of first conductive portions 420 are formed by bending the first conductive cover 400 and the second conductive cover 405 toward a direction of the inside of the insulated body 200 for electrically connecting with a conductive shell of the complementary connector (not shown), which is inserted in the serial bus connector 10. The plurality of second conductive portions 430 are formed by bending the first conductive cover 400 and the second conductive cover 405 toward an opposite direction of the insulated body 200. The plurality of first conductive portions 420 and the plurality of second conductive portions 430 are arranged spaced apart along a straight line on the first conductive cover 400 and the second conductive cover 405. That is, each second conductive portion 430 is located between two first conductive portions 420. Moreover, the first conductive cover 400 and the second conductive cover 405 further comprise a plurality of third conductive portions 440, which are formed on the other three sides of the hollowed-out portion. The plurality of third conductive portions 440 are formed by bending the first conductive cover 400 and the second conductive cover 405 toward the opposite direction of the insulated body 200. It should be noted that the plurality of the first conductive portions 420, the second conductive portions 430, and the third conductive portions 440 of the first conductive cover 400 and the second conductive cover 405 are a one-piece molded structure.

As shown on FIG. 1 and FIG. 5, in this embodiment, after the plurality of first conductive portions 420 of the first conductive cover 400 and the second conductive cover 405 extend into the inside of the insulated body 200, they bend toward a direction of the plurality of openings 220 of the insulated body 200, and are configured as a barb-like structure. It should be noted that when viewed from the first end 210 of the insulated body 200, the end of the first conductive portion 420 is lower than the inside surface of the insulated body 200 (as shown on FIG. 8). However, the scope of the present invention is not limited thereto.

As shown on FIG. 1 and FIG. 5, a pair of concave portions 270 are formed on the diagonal positions in the whole structure of the insulated body 200 (i.e. the adjacent positions between the left and right side walls and the top and bottom side walls). Each concave portion 270 has a same contour as the left and right bending side walls of the first conductive cover 400 or the second conductive cover 405, and the left and right bending side walls of the first conductive cover 400 and the second conductive cover 405 are respectively disposed on the pair of concave portions 270. It should be noted that a dent depth of the concave portion 270 is greater than or equal to the thickness of the first conductive cover 400 and the second conductive cover 405. Preferably, when the first conductive cover 400 and the second conductive cover 405 are respectively disposed on the corresponding concave portion 270, joint positions between two are coplanar.

Figure 6:
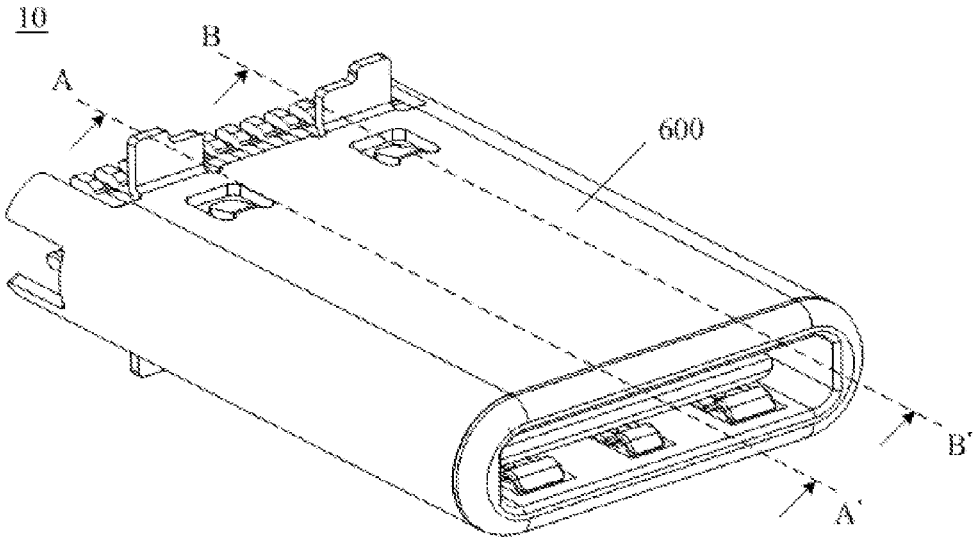
FIG. 6 shows an assembly diagram of a serial bus connector according to the present invention.

As shown on FIG. 2 and FIG. 6, after the base assembly 100, the plurality of terminals 300, the insulated body 200, and the conductive covers 400 and 405 are combined, they will be sleeved into the outer shielding 600. Since the outer perimeter of the first end 210 of the insulated body 200 is greater than the inner perimeters of the fourth end 625 and the third end 620 of the outer shielding 600, the outer shielding 600 is sleeved onto the third end 620 of the insulated body 200 from the direction of the second end 215. After sleeved, the outer shielding 600 is firmly covered on the side walls of the first conductive cover 400, the second conductive cover 405, and the insulated body 200. Thus, the plurality of the second conductive portions 430 and third conductive portions 440 of the conductive covers 400 and 405 are contacted with the inside top or bottom walls of the outer shielding 600 (as shown on FIG. 7).

As shown on FIG. 1 and FIG. 6, in order to prevent the outer shielding 600 from falling off or shifting position after sleeving, at least one tongue 610 is formed on the outer shielding 600, and at least one recess 160 is formed on the base assembly 100 at a location corresponding to the tongue 610. After assembled, the tongue 610 is engaged in the recess 160, thereby preventing retreatment of the outer shielding 600.

In summary, the serial bus connector according to the present invention is in conformity with the specifications of USB 3.1 and has a robust and small structure thereby providing the connector with a longer service life.

While the invention has been described in terms of various specific embodiments, those skilled in the art will recognize that the invention can be practiced with modification within the spirit and scope of the claims.

What is claimed is:

1. A serial bus connector, comprising:

an insulated body, comprising at least one side wall including a plurality of openings formed thereon and comprising a first end for connecting with a complementary connector;

a plurality of rows of terminals;

a base assembly comprising a plurality of terminal seats being superposed disposed one upon the other, each terminal seat is used for accommodating a part of each terminal and engaging with the insulated body;

at least one conductive cover located upon an outer surface of the side wall of the insulated body;

an outer shielding sleeved onto the insulated body and the at least one conductive cover, wherein the conductive cover is electrically connected with the outer shielding, and wherein each conductive cover comprises:

a plurality of first conductive portions which are formed by bending the conductive cover toward a direction of an inside of the insulated body, wherein the first conductive portions respectively pass through the openings of the insulated body to extend into the inside of the insulated body for electrically connecting with the complementary connector;

a plurality of second conductive portions, which are formed by bending the conductive cover toward an opposite direction of the insulated body, wherein the plurality of second conductive portions are electrically connected with the outer shielding.

2. The serial bus connector as claimed in claim 1, wherein the plurality of first conductive portions and the plurality of second conductive portions are arranged spaced apart along a straight line.

3. A serial bus connector, comprising:

an insulated body, comprising at least one side wall including a plurality of openings formed thereon and comprising a first end for connecting with a complementary connector;

a plurality of rows of terminals;

a base assembly comprising a plurality of terminal seats being superposed disposed one upon the other, each terminal seat is used for accommodating a part of each terminal and engaging with the insulated body;

at least one conductive cover located upon an outer surface of the side wall of the insulated body;

an outer shielding sleeved onto the insulated body and the at least one conductive cover, wherein the conductive cover is electrically connected with the outer shielding; and wherein the plurality of base seats comprise a first terminal seat and a second terminal seat, a pair of engaging units which can engage with one another are respectively formed on two opposite side walls of each terminal seat and two opposite side walls of the insulated body, each engaging unit comprises at least one pair of structurally complementary protrusive sections and notch sections, thereby engaging the insulated body with the base assembly.

4. The serial bus connector as claimed in claim 3, wherein each terminal comprises a spring contact section, a retaining section, and a connecting section, and the insulated body comprises a plurality of terminal passages formed on two opposite side walls of the insulated body for accommodating the spring contact section of the terminal.

5. The serial bus connector as claimed in claim 3, wherein the plurality of openings are respectively formed on two opposite side walls of the insulated body and adjacent to the first end.

6. The serial bus connector as claimed in claim 3, wherein the at least one insulated body comprises at least one concave portion corresponding to the at least one conductive cover, the concave portion has a same contour as the conductive cover, and a dent depth of the concave portion is greater than or equal to a thickness of the conductive cover.

7. The serial bus connector as claimed in claim 3, wherein the base assembly further comprises a central plate disposed between the first terminal seat and the second terminal seat, and the central plate comprises:

at least one elastic arm extended toward an end of the plurality of rows of terminals, wherein a hook section is formed on an end of the at least one elastic arm for electrically connecting with the complementary connector; and a ground extended toward another end of the plurality of rows of terminals.

8. The serial bus connector as claimed in claim 7, wherein the first terminal seat comprises at least one blind hole, the second terminal seat comprises at least one post, and the central plate comprises at least one through hole, the post is passed through the through hole and disposed on the blind hole.

9. The serial bus connector as claimed in claim 7, wherein the two opposite side walls of the insulated body comprise at least one embedding slot for accommodating the elastic arm of the central plate.

10. A serial bus connector, comprising:

an insulated body, comprising at least one side wall including a plurality of openings formed thereon and comprising a first end for connecting with a complementary connector;

a plurality of rows of terminals;

a base assembly for accommodating a part of each terminal and being assembled with the insulated body;

at least one conductive cover located upon an outer surface of the side wall of the insulated body, each conductive cover comprising:

a plurality of first conductive portions which are formed by bending the conductive cover toward a direction of an inside of the insulated body, wherein the first conductive portions respectively pass through the openings of the insulated body to extend into the inside of the insulated body for electrically connecting with the complementary connector; and a plurality of second conductive portions which are formed by bending the conductive cover toward an opposite direction of the insulated body; and an outer shielding sleeved onto the insulated body and the at least one conductive cover, wherein the plurality of second conductive portions are electrically connected with the outer shielding.

11. The serial bus connector as claimed in claim 1, wherein the plurality of first conductive portions and the plurality of second conductive portions are arranged spaced apart along a straight line.

12. The serial bus connector as claimed in claim 1, wherein each terminal comprises a spring contact section, a retaining section, and a connecting section, and the insulated body comprises a plurality of terminal passages formed on two opposite side walls of the insulated body for accommodating the spring contact section of the terminal.

13. The serial bus connector as claimed in claim 1, wherein the insulated body, comprises two opposite side walls, and the plurality of openings are respectively formed on the two opposite side walls of the insulated body and adjacent to the first end.

14. The serial bus connector as claimed in claim 1, wherein the at least one insulated body comprises at least one concave portion corresponding to the at least one conductive cover, the concave portion has a same contour as the conductive cover, and a dent depth of the concave portion is greater than or equal to a thickness of the conductive cover.

15. The serial bus connector as claimed in claim 1, wherein the base assembly further comprises a first terminal seat and a second terminal seat being disposed superposed one upon the other, each terminal seat is used for accommodating the part of each terminal, a pair of engaging units which can engage with one another are respectively formed on two opposite side walls of each terminal seat and two opposite side walls of the insulated body, each engaging unit comprises at least one pair of structurally complementary protrusive section and notch section, thereby engaging the insulated body with the base assembly.

16. The serial bus connector as claimed in claim 15, wherein the base assembly further comprises a central plate disposed between the first terminal seat and the second terminal seat, and the central plate comprises:

at least one elastic arm extended toward an end of the plurality of rows of terminals, wherein a hook section is formed on an end of the at least one elastic arm for electrically connecting with the complementary connector; and a ground extended toward another end of the plurality of rows of terminals.

17. The serial bus connector as claimed in claim 16, wherein the first terminal seat comprises at least one blind hole, the second terminal seat comprises at least one post, and the central plate comprises at least one through hole, the post is passed through the through hole and disposed in the blind hole.

18. The serial bus connector as claimed in claim 16, wherein the two opposite side walls of the insulated body comprise at least one embedding slot for accommodating the elastic arm of the central plate.

* * * * *